United States Patent [19]

Charron

[11] 4,178,027

[45] Dec. 11, 1979

[54] DOOR LOCK GUARD

[76] Inventor: Marcel Charron, 44 Church St., East Hartford, Conn. 06108

[21] Appl. No.: 929,444

[22] Filed: Jul. 31, 1978

[51] Int. Cl.[2] ..... E05B 17/00

[52] U.S. Cl. ..... 292/346; 70/418

[58] Field of Search ..... 292/346, 357, 1; 70/416, 418; 49/483, 462

[56] References Cited

U.S. PATENT DOCUMENTS

| | | | |
|---|---|---|---|
| 1,399,897 | 12/1921 | Singer | 292/346 |
| 1,814,961 | 7/1931 | Phillips | 292/346 |
| 3,279,840 | 10/1966 | Barone | 70/418 X |
| 3,290,081 | 12/1966 | Sushan | 292/346 |
| 3,592,498 | 7/1971 | Raccuglia | 292/346 |
| 3,874,717 | 4/1975 | Pratt | 70/418 X |
| 4,017,106 | 4/1977 | Salazar | 70/416 X |

FOREIGN PATENT DOCUMENTS

| | | | |
|---|---|---|---|
| 979051 | 12/1975 | Canada | 292/346 |
| 491285 | 8/1938 | United Kingdom | 292/346 |

*Primary Examiner*—J. Franklin Foss

[57] ABSTRACT

A door lock guard comprising two cooperating guard plates, the guard plates preferably having identical configurations, the first plate capable of being mounted on the edge of a door and the second plate capable of being mounted on the doorjamb which receives the door. Each guard plate includes a support plate having a generally rectangular shape and including a cutout which allows for the protrusion of either a latchbolt plate or a strike plate. A pair of flanges extend respectively in opposite directions from opposite edges of the support plate. Preferably, the flanges are perpendicular to the support plate. One of the flanges includes an aperture for receiving a tongue and the other flange includes a tongue which extends in generally parallel relation to the support plate. When the guard plates are mounted respectively on the door and the doorjamb, and the door is closed, the tongue of each cooperating plate fits within the aperture of the other plate to provide a lock guard which prevents unauthorized opening of the lock from either side of the door.

8 Claims, 2 Drawing Figures

DOOR LOCK GUARD

BACKGROUND OF THE INVENTION (1) Field of the Invention

The present invention relates to locking mechanism for doors. More particularly, the present invention relates to mechanisms door lock guard for preventing unauthorized opening of a bolt type lock.

(2) Description of the Prior Art

It is well known that individuals making an unauthorized entry through a locked door often gain entry by insertion of a flexible tool between the door and the doorjamb to force the bolt away from the doorjamb and into the door so that the door may be opened. Persons may also gain unauthorized entry into a house or building by forcing the door open.

Various designs for door lock guards are known. Generally speaking, the prior art door lock guards are unduly complicated, that is, they require a large number of parts and require intricate machining or bending of the parts. Moreover, some prior art door lock guards require that the door or doorjamb be altered substantially in order to affix the door lock guard. Other door lock guards require an inordinate amount of time for a carpenter to install the door lock guards. Other prior art door lock guards necessitate that the parts of the door lock guard be aligned very accurately and precisely in order for the door lock guard to function properly.

In general, prior art door lock guards include at least two parts. One part fits onto the doorjamb and the other part fits on the door which is adapted to fit within the doorjamb. Generally speaking, the part which is fitted on the doorjamb is quite different in design from the part fitted on the door. Thus, an entirely different set of tools or forming dies must be used in order to fabricate the two parts.

Examples of the door lock guards described above may be found in the following patents: U.S. Pat. Nos. 973,001; 1,853,456; 2,454,904; 3,271,063; 3,279,840; 3,290,081; 3,377,094; 3,405,962; 3,592,498; 3,764,173; 3,963,269.

It is an object of the present invention to provide a door lock guard which prevents insertion of a flexible tool between the door and the doorjamb.

It is another object of the present invention to provide a door lock guard which is compatible with conventional door locks and which does not require extensive alteration of the door or the doorjamb.

It is another object of the present invention to provide a door lock guard which prevents insertion of a flexible tool between the door and the doorjamb from either side of the door.

It is another object of the present invention to provide a door lock guard having a first part which is affixed to the door and a second part which is affixed to the doorjamb, the first and second parts being identical so as to reduce fabrication time and tooling requirements.

SUMMARY OF THE INVENTION

The door lock guard of the present invention comprises two cooperating guard plates. The first guard plate is mounted on the edge of a door and the second guard plate is mounted on the doorjamb which receives the door. Each guard plate includes a support plate preferably having a generally rectangular shape, each guard plate having a pair of flanges which extend in opposite directions from opposite edges of the support plate. Preferably, the flanges are perpendicular to the support plate. One of the flanges includes an aperture for receiving a tongue and the other flange defines a tongue which extends preferably in parallel relation to the support plate. The support plate includes a cutout which allows the the strike plate to protrude therethough when one of the cooperating guard plates is mounted on the doorjamb. The cutout allows for protrusion of the bolt and the latch bolt plate when the cooperating guard plate is mounted on the door. The support plate also includes a plurality of holes which allow for insertion of screws to secure the cooperating guard plates to the door and doorjamb.

When one of the cooperating guard plates is mounted on the door and the other cooperating guard plate is mounted on the doorjamb, and the door is closed, the tongue of each guard plate fits within the aperture of the other guard plate to provide for tongue-aperture interlocking on both sides of the door. When the door is in the closed position, the support plates are in face to face relation, and it is difficult or impossible to gain access to the screws which secure the support plates to the door and the doorjamb.

One particularly advantageous aspect of the present invention is that the guard plates, in the preferred embodiment of the invention, are identical thereby reducing fabrication time and tooling costs. It is also noted that the cooperating guard plates of the present invention provide for a double interlocking. That is, the tongue of the first guard plate engages the aperture to the second guard plate while the tongue of the second guard plate engages the aperture of the first guard plate. Thus, the bolt of the conventional door lock is inaccessible from either side of the door. This is particularly useful in the case wherein the door is locked from either side.

DETAILED DESCRIPTION OF THE INVENTION

Figure 1:
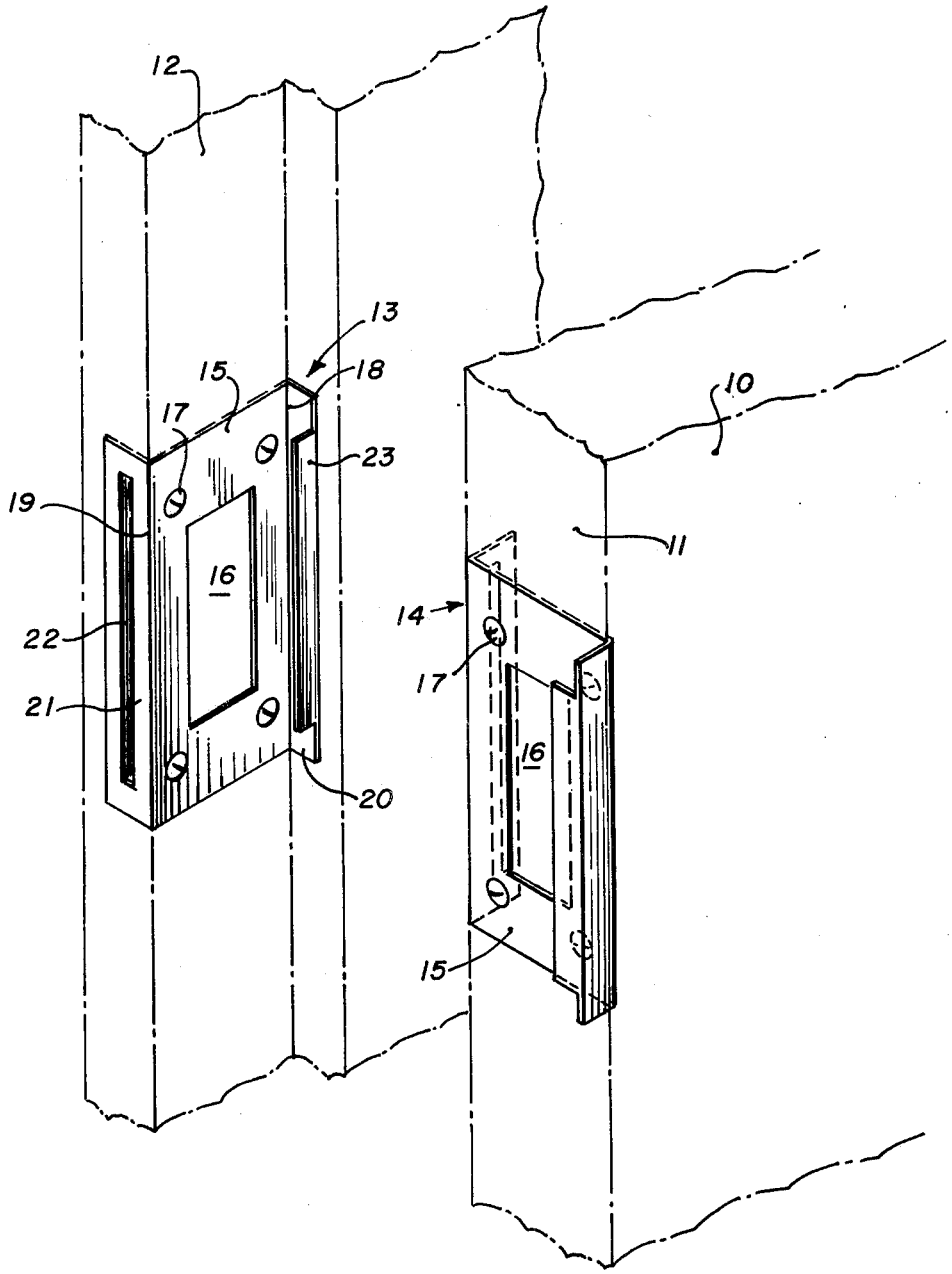
FIG. 1 is a perspective view of the cooperating guard plates of the present invention affixed to a doorjamb and a door.
Figure 2:
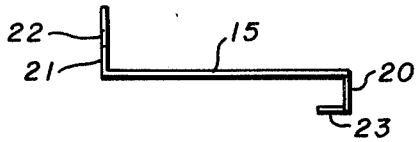
FIG. 2 is a top elevational view of a guard plate in accordance with the present invention.

Referring to the FIGURES, a conventional door and doorjamb assembly is shown. When the door is closed, door 10 having end 11 fits into doorjamb 12. The door is of the type having a conventional bolt lock. A conventional bolt and latchbolt plate which protrudes from the door and conventional strike plate which protrudes from the doorjamb are omitted from the FIG. 1 in the interest of simplicity. It should be understood that a number of different types of conventional locks can be used with the door lock guard of the present invention.

The door lock guard comprises a doorjamb plate 13 and a door plate 14, the plates 13 and 14 cooperating with one another to provide for a lock guard to prevent an insertion of a tool from either side of the door.

Each of the cooperating plates 13 and 14 includes a support plate 15 having preferably a generally rectangular shape. Plate 15 includes a cutout 16 which, in the case of a doorjamb, allows for protrusion of a conventional strike plate, and, in the case of a door, allows for the protrusion of a conventional latchbolt plate and bolt. Although cutout 16 is shown as having a rectangular shape, it should be understood that other shapes which allow for protrusion of the strike plate and the latchbolt plate and bolt may be used. Support plate 15 includes a plurality of holes 17 which allow for insertion of screws therethrough to secure the support plates 15 to the door 10 and the doorjamb 12. Support plate 15 includes two oppositely disposed edges 18 and 19. Flange 20 extends from edge 18 in perpendicular relation to support plate 15 and flange 21 extends from edge 19 in perpendicular relation to support plate 15, flange 20 extending in a direction opposite to the direction of flange 21. Flange 21 includes an elongated aperture 22 which preferably extends a large portion of the length of flange 21. Flange 20 includes a tongue 23 which protrudes from flange 20 in a direction generally parallel to plate 15.

As shown in FIG. 1, the door is in the open position and the door lock guard is in the unlocked position. When door 10 is pivoted about its hinges to a closed position, doorjamb plate 13 cooperates with door plate 14 to provide for a lock guard on both sides of the door. When the door 10 is in the closed position, tongue 23 of doorjamb plate 13 fits within aperture 22 of door plate 14. Similarly, the tongue 23 of door plate 14 fits within aperture 22 of doorjamb plate 13. Optionally, flange 20 may include two additional holes to allow securement of flange 20 to the door jamb.

In the preferred embodiment of the door lock guard, the doorjamb plate 13 is identical to the door plate 14. Thus, fabrication time and tooling costs are minimized.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A guard plate for use in a door lock guard, for use with locks of the type having a strike plate attached to a doorjamb and a latchbolt plate attached to a door, the guard plate comprising:

a support plate which is capable of being attached to a doorjamb or a door, the support plate including a cutout providing for protrusion of the strike plate or the latchbolt plate, said support plate defining two oppositely disposed edges;

a first flange extending from one edge of said support plate in a direction angled with respect to said plate said flange terminating in tongue which extends in generally parallel relation to the support plate; and a second flange extending from said second edge of the support plate, said second flange including an aperture, said flanges extending in opposite directions with respect to each other.

2. A guard plate according to claim 1 wherein the guard plate is formed from a sheet and said flanges are integral with said support plate.

3. A guard plate according to claim 2 wherein the cutout in said support plate has a generally rectangular shape.

4. A guard plate according to claim 3 wherein said support plate includes a plurality of holes which allow for insertion of screws therethrough.

5. A guard plate according to claim 4 wherein said tongue means has a generally rectangular shape and is integral with said first flange.

6. A plate according to claim 5 wherein said aperture has a generally elongated rectangular shape.

7. A door lock guard comprising a pair of guard plates as defined in claim 1, the tongue of the first guard plate capable of engaging the aperture of the second guard plate and the tongue of the second guard plate capable of engaging the aperture of the first guard plate.

8. A door lock guard according to claim 7 wherein the first guard plate and the second guard plate are identical.

* * * * *